United States Patent [19]

Goodspeed

[11] Patent Number: 4,822,428

[45] Date of Patent: Apr. 18, 1989

[54] APPARATUS FOR CLEANING AIR PORTS OF A CHEMICAL RECOVERY FURNACE

[76] Inventor: Byron L. Goodspeed, 1111 Holcomb Rd., Kelso, Wash. 98626

[21] Appl. No.: 43,947

[22] Filed: Apr. 29, 1987

[51] Int. Cl.[4] ..... B08B 9/00

[52] U.S. Cl. ..... 134/6; 15/246; 110/182.5; 122/379; 122/387; 134/166 R; 422/185

[58] Field of Search ..... 422/185; 15/246, 93 R; 122/379, 235 B, 387; 110/182.5; 134/166 R, 6

[56] References Cited

U.S. PATENT DOCUMENTS

| | | | |
|---|---|---|---|
| 4,423,533 | 1/1984 | Goodspeed | 266/269 |
| 4,538,552 | 9/1985 | Smuda | 122/235 B |
| 4,653,409 | 3/1987 | Eriksson | 122/235 B |

*Primary Examiner*—Barry S. Richman

*Assistant Examiner*—Jill Johnston

*Attorney, Agent, or Firm*—Dellett, Smith-Hill & Bedell

[57] ABSTRACT

Apparatus for cleaning air ports in a chemical recovery furnace includes a plurality of rods, each having a cleaning tip thereon, mounted on a wind box adjacent the furnace. The rods are longitudinally slidable to insert the cleaning tips into the air ports, and are rotatable about an axis perpendicular to the longitudinal axis of the rods so as to index the cleaning tips to a new point of insertion into the air port opening. An air cylinder actuator is employed to insert the cleaning tips into the openings in a ramming motion to dislodge residual buildup in the air port opening, retract the cleaning tips from the air port openings, and index the tips to a new point of insertion. Successive invocation of the actuating means results in removal of residual buildup along the entire length of the air port openings.

30 Claims, 6 Drawing Sheets

APPARATUS FOR CLEANING AIR PORTS OF A CHEMICAL RECOVERY FURNACE

BACKGROUND OF THE INVENTION

The present invention relates to furnaces and particularly to apparatus for automatically cleaning ports introducing combustion air into the firebox of a chemical recovery furnace.

Wood pulp for papermaking is usually manufactured according to the sulfate process wherein wood chips are treated with a cooking liquor including sodium sulfide and sodium hydroxide. The wood chips and the cooking liquor, called "white liquor," are cooked in a digester under predetermined heat and temperature conditions. After cooking, the used liquor, termed "black liquor," containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries and melts the spent cooking chemicals as they fall to the floor of the firebox, where they build a mound of material called a char bed. The char bed is further heated to further liquify the chemicals into a molten smelt that flows out of the furnace through a smelt spout to a collection tank. Concurrently, combustion heat is employed to generate steam in a water wall of the boiler for use as process steam and for generating electricity.

The combustion process requires the introduction of large volumes of air into the firebox, air comprising about 80 percent of the material entering the furnace. The air is forced into the firebox from wind boxes or ducts disposed at several levels on surrounding relation to the firebox, through a plurality of air ports in the walls of the furnace, viz.:primary, secondary and tertiary air ports. The primary air ports, through which about 40 to 50 percent of the air enters the furnace, are disposed on the side walls of the firebox near the bottom of the furnace close to the char bed. The secondary air ports, through which about 35 percent of the air enters the furnace, are disposed around the walls of the firebox, higher than the primary air ports, and closer to the entry conduits through which the black liquor is sprayed into the firebox. While the primary air ports provide a relatively large volume of air with considerable turbulence for maintaining a fireball in the char bed, the secondary and tertiary air ports provide a finer control and distribution of air above the char bed and distribute the air evenly in the black liquor spray to support the combustion thereof.

The black liquor sprayed into the firebox, having a consistency like warm 60 weight oil, swirls, burns and falls toward the bottom of the firebox as combustion products comprising char material and smelt. The smelt and char material contact the outer walls of the firebox and, cooled by the inflowing air, form excrescent deposits around edges of the air ports, particularly along the edges of the openings where the excrescent material builds up and around the openings under influence of air rushing through the air port. Such buildup of char material can block air flow through the ports by as much as ten percent, and can even block individual ports completely. In accordance with customary practice, the char build-up is periodically removed by a worker inserting a rod into the air ports successively around the boiler. With manual rodding of the air ports, gradual buildup of char material intermittently around the furnace causes changes in the volume of combustion air, as well as changes in air distribution, velocity and pressure. Therefore, furnace operation tends to be inefficient and unpredictable with an attendant decrease in the amount of chemicals that can be recovered, a decrease in the amount of steam produced per unit of fuel, and increased emission of noxious gases such as carbon monoxide and sulfur dioxide.

Apparatus for cleaning openings in a recovery furnace are known—see my copending U.S. patent application Ser. No. 829,712, filed Feb. 13, 1986, entitled APPARATUS FOR CLEANING AIR PORTS OF A CHEMICAL RECOVERY FURNACE, and my U.S. Pat. No. 4,423,533, entitled FURNACE AIR PORT CLEANER. The apparatus disclosed therein includes rods with cleaning tips attached to an end of each rod, and the cleaning action is a wiping motion accomplished by inserting the cleaning tips into corresponding openings and then changing the position of the rods, while the cleaning tips are within the openings, so as to cause the cleaning tips to wipe or move along the length of the openings to dislodge the buildup therein. It has been found that particularly hard deposits of solidified smelt and char material resembling a vitreous substance may resist the wiping action of the cleaning tip and in extreme instances may cause individual rods to stress and even bend. It is desirable therefore to provide a cleaning action in which the cleaning tip acts as a ram, wherein force is applied longitudinally of the rod, while still cleaning the longitudinal height of the air port opening without disrupting or blocking combustion air flow through the port either while cleaning or while the cleaning apparatus is in an at-rest position.

It is accordingly an object of the present invention to provide improved apparatus for cleaning air ports of a chemical recovery furnace.

Another object of the present invention is to provide improved air port cleaning apparatus for increasing the operational stability of a black liquor recovery boiler.

It is a further object of the present invention to provide improved air port cleaning apparatus for enhancing the efficiency of chemical recovery, increasing steam production, and reducing sulfur dioxide and carbon monoxide emissions from a black liquor recovery boiler.

Yet another object of the present invention is to provide an air port cleaning apparatus in which the cleaning rods are not subject to lateral stress.

SUMMARY OF THE INVENTION

According to the present invention, in a preferred embodiment thereof, furnace air ports are cleaned automatically by apparatus comprising a rod having a cleaning tip adapted for insertion through a port by longitudinal translation of the rod, the cleaning tip being moved into the air port as by ramming to dislodge excrescent material in the air port. The cleaning tip is then retracted and indexed, and the ramming operation repeated at a different point of insertion in the air port opening.

In accordance with the invention, an actuator applies force longitudinally of the rod to move the cleaning tip into the air port opening and subsequently retract the rod, the retraction force being translated to an index mechanism that repositions the cleaning tip by a predetermined interval of space. With each repeated insertion and retraction of the cleaning tip, the tip is moved so that the cleaning operation, i.e., the ramming motion of the cleaning tip, is repeated at specific intervals of space over the length of the air port opening, thereby cleaning the entire opening.

According to another embodiment, the cleaning tip is provided with serrate edges for cutting or chipping hardened excrescent material in the opening.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
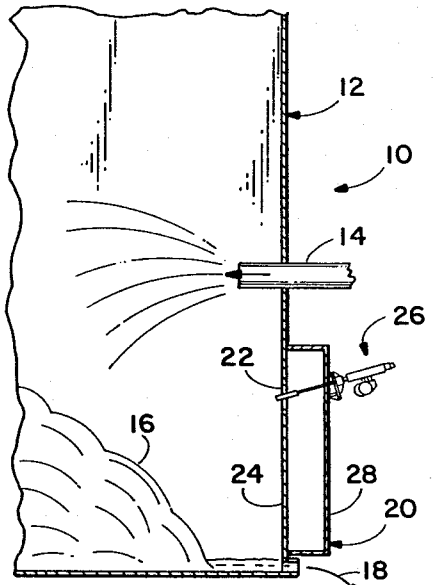
FIG. 1 is a schematic view of a portion of a chemical recovery furnace in which the present invention is employed.

Referring to the drawings and particularly to FIG. 1, the present invention is adapted for use in connection with a chemical recovery furnace 10 which comprises the firebox 12 for a steam boiler. "Black liquor", as hereinabove described, is sprayed into the firebox 12 via conduit 14, with the chemicals being deposited on the floor of the firebox 12 as a char bed 16 from which a molten chemical-containing smelt 18 is recovered for further treatment. A wind box 20 substantially surrounds the firebox 12 and delivers combustion air under pressure into the firebox 12 through a multiplicity of air port openings 22 in a wall 24 of the firebox 12.

In accordance with the present invention, apparatus 26 for cleaning the air port openings is attached to the outer wall 28 of the wind box 20, and is adapted to clean the air port openings 22 in the wall 24 of the firebox 12.

Referring now to FIGS. 2–5, illustrating cleaning apparatus 26 in greater detail, the apparatus comprises a plurality of rods 30 each provided with a cleaning tip 32 adapted for insertion into one of the air port openings 22 in the firebox wall 24. The apparatus described herein comprises four such rods with the cleaning tip on the forward end of each rod, but it is understood a greater or lesser number of rods could have been included in each unit. The unit as disclosed is conveniently manageable, and can be easily removed and transported from the furnace 10 in the event access is required to the interior of the wind box 20. The rods 30 are suitably formed from stainless steel, while the cleaning tips 32 are suitably formed as by casting from a high chromium ferritic alloy such as No. 446. Alternatively, a high nickel alloy steel may be employed, but in any case the material should be such that the forward end of the tip can withstand the high temperatures of the firebox (typically 1,700° F.) for short periods. The cleaning tips may extend crossways of the corresponding air port opening 22 to fill a substantial portion of the lateral dimension of the opening, or alternatively be configured as a ram having a square cross-section, in the latter configuration, being approximately one and one-fourth inches square with a rounded end. The presently described embodiment of the invention preferably utilizes such a ram configuration of the tip so as to contact and dislodge relatively hard deposits of solidified smelt and char material that build up in and around the air port opening 22. The cleaning tips 32, are substantially smaller in vertical cross-section than the long distance or height of the air port opening 22 into which the tip is adapted to extend. Therefore, as hereinafter more fully explained, the tip may be indexed to penetrate the opening 22 at a plurality of locations traversing the longitudinal dimension of the corresponding air port opening for dislodging the char buildup therefrom.

Mounting means are provided for attachment of the cleaning apparatus 26 to the outer wall 28 of the wind box 20 for pivotally and slidably mounting the rods 30. The mounting means comprises a faceplate 34 received in and attached to a frame 36 covering an opening 38 in the wall 28 of the wind box. The frame 36 is disposed at an angle such that the rods 30 suitably extend, in relation to the wall 28, angularly downward toward the air port openings 22. The mounting means further comprises a plurality of mounting assemblies 40, secured by bolts 42 to the faceplate 34, and pivotally receiving tubes 44, which are journaled in bearings 46. The rods 30 are each slidably disposed within a corresponding tube 44 such that each may be longitudinally translated within the tube 44 and rotated about a pivot 48 having an axis of rotation parallel to walls 24, 28 and perpendicular to the longitudinal axis of the rods 30.

Figure 3:
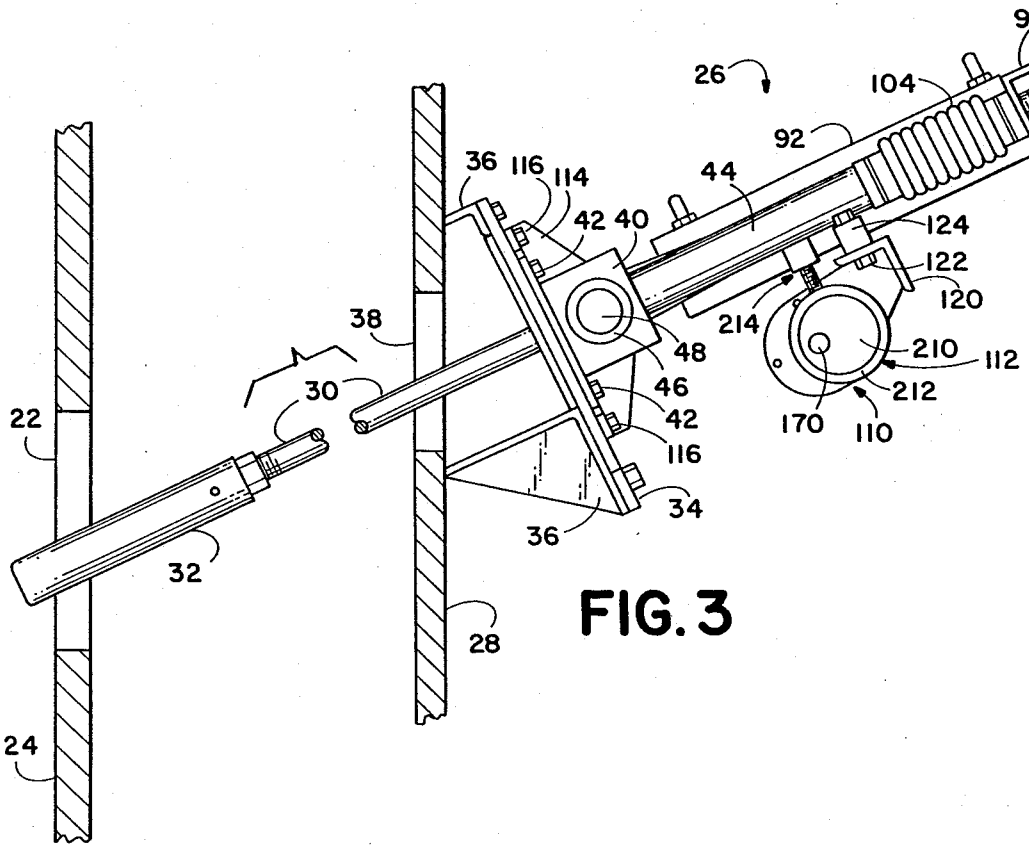
FIG. 3 is a longitudinal cross section of apparatus according to the present invention as taken at lines 3—3 in FIG. 2.
Figures 6, 7:
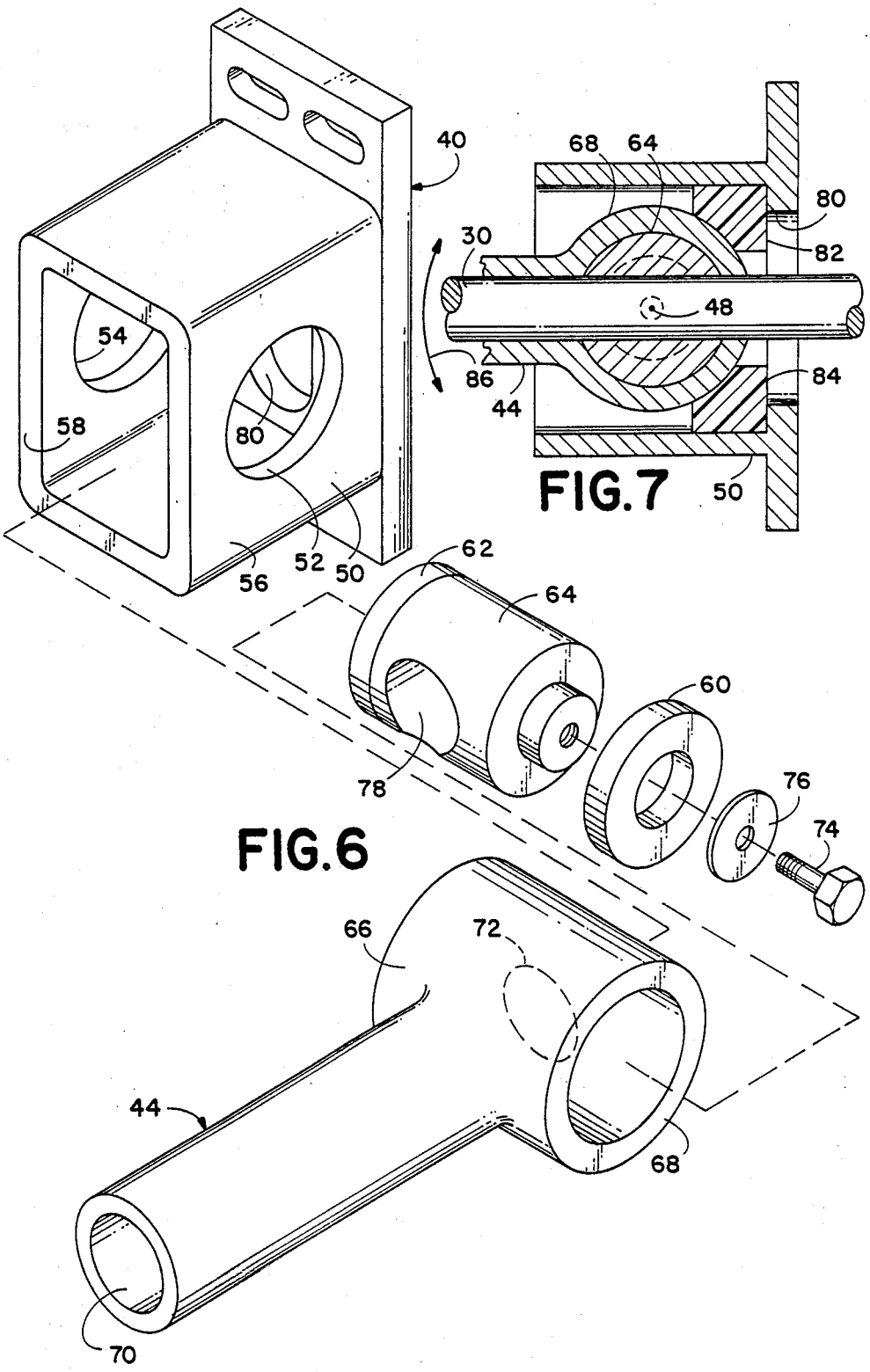
FIG. 6 is an exploded view of a mounting assembly utilized in the present invention.
FIG. 7 is a section view of the apparatus of FIG. 6.

Referring to FIGS. 6 and 7 in conjunction with FIG. 3, the mounting assembly 40 for pivotally and slidably mounting the rod 30 to the faceplate 34 includes a housing 50 having a transverse bore 52, 54 through both side walls 56, 58 thereof for receiving bearings 60, 62 mounted on a fulcrum rotating cylinder 64. The tube 44 comprises a T-shaped member 66 having a cylindrical sleeve 68 into which the cylinder 64 is slidably received. The bore 70 of tube 44 is perpendicular to the axis of the sleeve 68 and extends through the back wall 72 of the sleeve 68 for slidably receiving and supporting the rod 30. The cylinder 64 is adapted to receive the bearing 60 through which a bolt 74 extends for threadable engagement in an end of the cylinder 64. A lock washer 76 is suitably disposed between the head of bolt 74 and the bearing 60. The fulcrum rotating cylinder 64 is provided with a transverse bore 78 coaxial with the bore 70 of tube 44 when the cylinder 64 is disposed inside the cylindrical sleeve 68. The rod 30 extends through the bore 70 of tube 44 and the transverse bore 78 of the fulcrum rotating cylinder 64 into the wind box. The housing 50 is also provided with a vertically elongated opening 80 through which the rod 30 extends, and teflon seals 82, 84 in the rear corners of the housing 50. This construction provides an effective air seal for preventing the escape of any substantial amount of air from the wind box while allowing pivoting motion of the rod 30. The rod 30 is thus free to move both longitudinally and in rotation about the pivot 48 in the direction indicated by the arrows 86, FIG. 7, as the rod 30 effects a cleaning cycle.

Referring now to FIGS. 2–5, means for translating the rods 30 within the tubes 44 comprises a crossbar 90 suitably made of steel tubing, and an actuator or air cylinder 92. The crossbar 90 extends laterally of the rods 30 and is affixed by bolts 94 to each of rods 30 at an end 96 thereof opposite cleaning tips 32, thus unifying the longitudinal translation of the plurality of rods 30. The air cylinder 92, having a piston rod 98 rotatably connected to faceplate 34 by a pivot 100, is affixed to crossbar 90 by a bolt 102 and is employed to actuate rods 30 in longitudinal translation with respect to faceplate 34. Pivot 100 provides an axis of rotation substantially colinear with that provided by pivot 48 such that air cylinder 92 and rods 30 rotate about a substantially common axis. Cleaning tips 32 may be inserted within openings 22 by actuating air cylinder 92 to cause crossbar 90 to move toward the faceplate 34, and are retracted from openings 22 by reversing the stroke of the air cylinder 92. A boot or bellows 104, suitably made from synthetic rubber, protects the otherwise exposed portions of rods 30 when the rods are in a retracted position.

Figure 4:
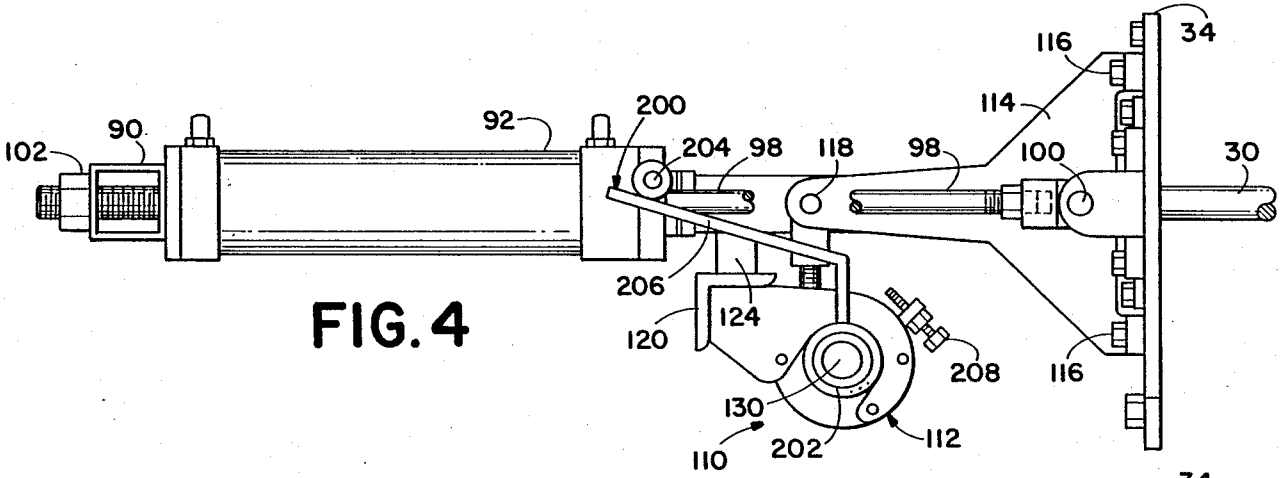
FIG. 4 is a side view taken at lines 4—4 of FIG. 2 showing the cleaning apparatus with the cleaning tip in a retracted position.
Figure 5:
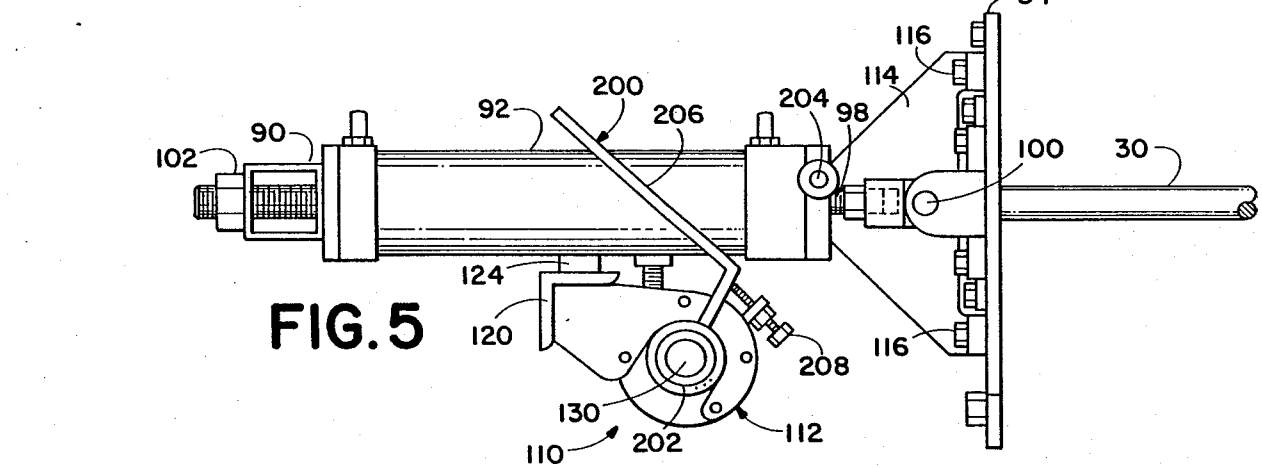
FIG. 5 is a view similar to FIG. 4 illustrating the cleaning apparatus with the cleaning tip inserted.

The cleaning tips 32 of the rods 30 are indexed, in accordance with one embodiment of the invention, by rotating the rods about the axis of pivot 48 perpendicular to the longitudinal axis of the rods, as the cleaning tips are being withdrawn from the openings 22. An indexing mechanism 110 comprises a clutch assembly 112 coupled between the rod assembly and the faceplate 34. A reference plate 114 affixed to the faceplate 34 by bolts 116 extends outward from the faceplate toward the actuator 92, as seen in FIG. 4, and provides a reference bearing 118 for attachment of the clutch assembly 112. A second crossbar 120 is attached to each of the tubes 44 by bolts 122 through a weldment 124 to unify the rotational translation of the rod assembly about the pivot 48. The clutch assembly 112 is attached to crossbar 120, and is employed to move crossbar 120 incrementally in relation to the reference plate 114 so as to cause an angular displacement of the rods 30 about the pivot 48, and thus index the cleaning tips 32 to provide a new point of insertion of the cleaning tips 32 into the openings 22.

Figure 8A:
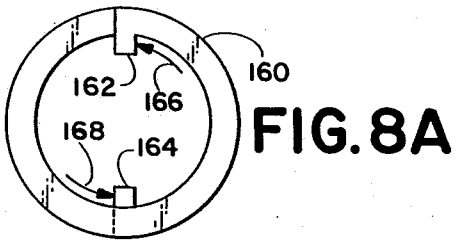
FIG. 8 is a section view of a no-back clutch utilized in the present invention.
Figure 8:
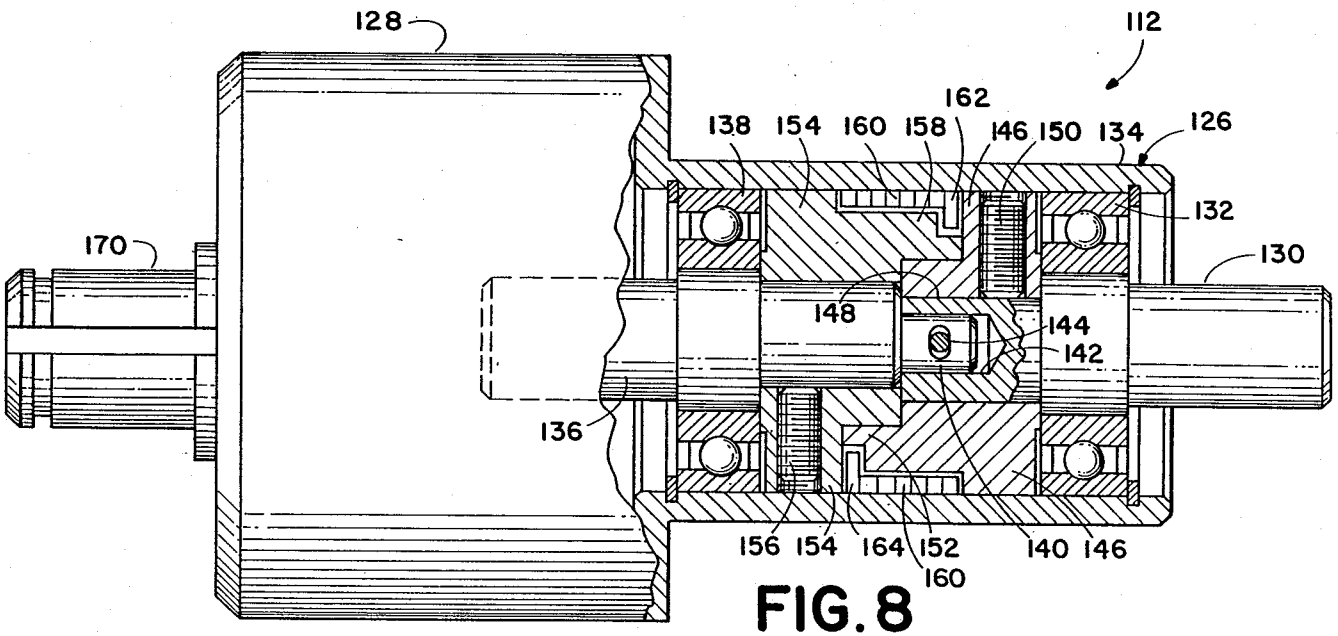

Referring now to FIG. 8, the clutch assembly 112 is shown in greater detail comprising a first clutch 126, which is a no-back clutch, coupled coaxially with a second clutch 128, the latter being a torque-limiting clutch of the type having spring segments wrapped about the shaft. The no-back clutch 126 comprises an input shaft 130 journaled in a bearing 132, which bearing 132 is pressed into a cylindrical housing 134 of the clutch assembly 112, and an output shaft 136 journaled coaxially with the input shaft 130 in a second bearing 138, the bearing 138 being pressed into the cylindrical housing at the end thereof opposite the first bearing 132.

A spindle 140 machined on the internal end of output shaft 136 is received in a corresponding aperture 142 machined in the end of the input shaft 130. The input and output shafts 130, 136 are loosely joined by way of a pin 144 such that the input shaft 130 rotates several degrees before the output shaft 136 follows. The no-back clutch mechanism comprises an input bearing block 146 disposed in substantially surrounding relation of the input shaft 130 and keyed to a flat 148 of the input shaft 130, the input bearing block 146 being affixed to the shaft 130 for rotation therewith by a set screw 150. A finger or actuating member 152 of the bearing block 146 extends longitudinally beyond the internal end of the input shaft 130. An output bearing block 154, similarly affixed to the output shaft 136 by a set screw 156, is disposed in substantially surrounding relation of the output shaft 136 and includes a finger or actuating member 158 extending longitudinally toward and interdigitated with the actuating member 152 of the input bearing block 146. A coil spring 160, compressed and disposed interiorly of the housing 134, surrounds the interdigitated bearing blocks 146, 154, and normally bears against the interior surface of the housing 134. End tabs 162, 164 of the coil spring 160 protrude such that either of the bearing blocks 146, 154 makes contact with the tabs to coil or uncoil the spring 160.

Referring to FIG. 8A, when torque is applied to the input shaft 130, the input bearing block 146 contacts the end tab 162 of the coil spring 160 and applies force thereto in a direction indicated by the arrow 166, which tends to compress the coil spring 160. Simultaneously, the output bearing block 154 holds the second end tab 164 and the spring 160 compresses, which relieves the grip of the coil spring on the interior of the housing and allows the output shaft 136 to rotate with the input shaft 130. When torque is applied to the output shaft 136, however, the output bearing block 154 contacts the end tab 164 and applies force thereto in the direction indicated by the arrow 168 to uncoil or open the coil spring 160 against the interior of the housing 134 and provide a binding force thereagainst that prevents the output shaft 136 from rotating with respect to the housing 134. The no-back clutch 126 thus has the following operational characteristics:Torque applied to the input shaft 130 is transferred to the output shaft 136; however, the output shaft 136 will not move in response to torque applied thereto, and such torque applied to the output shaft 136 is not transferred to the input shaft 130. It is possible that excessive torque could be applied to the output shaft 136 and thereby damage the internal components of no-back clutch 126; therefore, the torque-limiting clutch 128 is connected between the output shaft 136 of the no-back clutch 126 and an output shaft 170 of the clutch assembly 112. When torque applied to the output shaft 170 of the clutch assembly 112 exceeds a predetermined limit, 300 inch-pounds in the presently described embodiment of the invention, the torque-limiting clutch 128 allows the output shaft 170 to turn independently of the shaft 136 output of the no-back clutch 126. The construction and operation of spring segment torque-limiting clutches is well known in the art.

Referring again to FIGS. 2-5, a lever arm 200 is connected by an indexing or backstopping clutch 202 to the input shaft 130 of the clutch assembly 112. The backstopping clutch 202 is suitably a drawn cup roller clutch, which transmits torque to the shaft in one direction and allows free overrun in the opposite direction. The lever arm 200 extends radially from the clutch assembly 112 generally in the direction of a cam follower 204, which is connected to the actuator 92, and includes a dogleg portion 206 oriented with respect to the line of travel of the cam follower 204 such that the impulse imparted to lever arm 200 upon initial contact with cam follower 204 is reduced. The orientation of the dogleg portion 206 also serves to reduce the total angular rotation of lever arm 200. As the actuator 92 completes a retraction stroke, cam follower 204 contacts the lever arm 200 on its dogleg portion 206 and rotates the input shaft 130 counterclockwise with reference to FIGS. 4 and 5 to produce a torque on the input shaft 130. A return spring (not shown) urges the roller clutch 202 clockwise, in its direction of overrun, such that as the actuator 92 performs an insertion stroke, lever arm 200 is free to move against an adjustable stop 208 in preparation for the next retraction stroke. Thus, upon each retraction stroke of the actuator 92, lever arm 200 is in a position to receive the cam follower 204 and translate force from the actuator to torque on the input shaft 130, the amount of angular displacement of input shaft 130 being controllable by adjustment of the stop 208.

An eccentric 210, see FIG. 3, is connected to the output shaft 170 of the clutch assembly 112 and is rotationally disposed within a ring bearing 212 held against motion relative to the reference plate 114 by a link 214. Upon rotation of the output shaft 170, eccentric 210 is rotated within ring bearing 212, and the second crossbar 120, being rigidly affixed to the clutch assembly 112, is moved relative to the reference plate 114. Thus, torque transmitted to the input shaft 130 by the retracting air cylinder 92 results in an angular displacement of rods 30 about the pivot 48.

Figure 10:
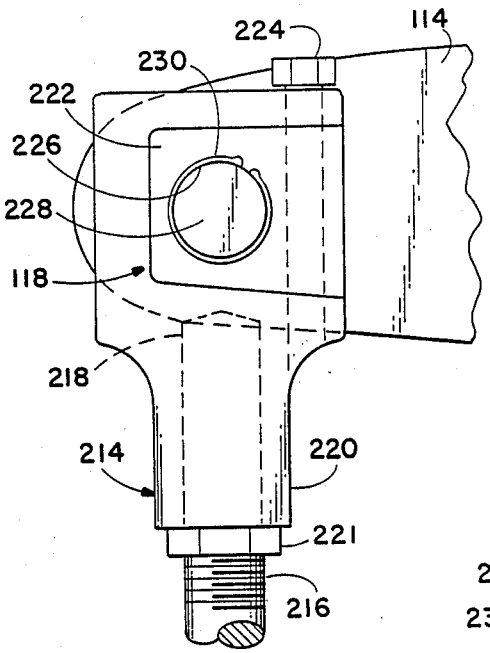
FIGS. 9 and 10 are detail views of a portion of an indexing means in accordance with the present invention.
Figure 9:
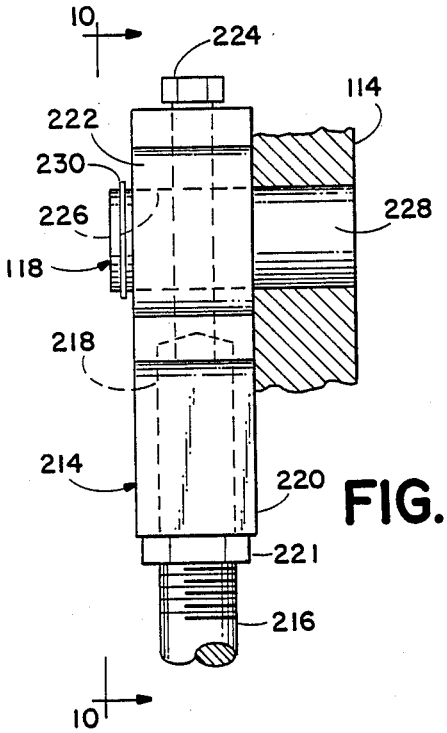

The link 214, which is proximally affixed to the ring bearing 212 and rotatably connected at the distal end thereof to the reference bearing 118 of reference plate 114, is adjustable in length to control the vertical offset of the range of displacement of the cleaning tips 32. Referring to FIGS. 9 and 10, which show the rotatable connection of link 214 to reference plate 114 in greater detail, a threaded rod 216 is rigidly connected at one end thereof to ring bearing 212 (see FIG. 3), and at the other end 218, is threaded within a connecting member 220 and held by a lock nut 221. A wear block 222 is disposed within a U-shaped portion of connecting member 220 and held therein by a bolt 224 engaging both connecting member 220 and wear block 222. Wear block 222 includes a bore 226 therethrough dimensioned to receive a hardened pivot pin 228 rigidly connected to and extending perpendicularly from the reference plate 114, the wear block 222 being held on the pivot pin 228 by a C-clip 230. Pivot pin 228 and the wear block 222 thus form the rotatable connection between link 214 and reference plate 114. The length of the link 214 is determined by the extent to which threaded rod 216 is threaded within connecting member 220. When wear block 222 is worn, it may be easily replaced without affecting the length adjustment of link 214, as would be the case if the entire link 214 were to be replaced.

Referring to FIGS. 2-5, in operation, a cleaning cycle consists of a series of insertions and retractions of the cleaning tips 32, into the openings 22, each insertion and retraction occurring at a different point along the longitudinal dimension of the openings 22. The cleaning cycle begins from a rest position with cleaning tips 32 retracted from openings 22, and as the air cylinder 92 is activated to perform an insertion stroke, the cleaning tips 32 enter openings 22 at a first point of insertion. When the air cylinder 92 reaches the end of its insertion stroke, it reverses direction to retract cleaning tips 32 from openings 22, and over the last few inches of the retraction stroke, cam follower 204 contacts the lever arm 200 to actuate the clutch assembly 112 to rotate the rods 30 about the pivots 48. Rotation of the rods 30 allows cleaning tips 32, upon the next insertion stroke, to enter openings 22 at a second point of insertion spaced apart from the first point of insertion. During one cleaning cycle, the cleaning tips 32 are indexed successively a sufficient number of times, eight in the presently described embodiment of the invention, to clean all portions of the openings 22.

The cleaning tips 32 dislodge residual buildup from the edges surrounding openings 22 during their insertion and not during the change in angular position of rods 30. In the prior apparatus, the cleaning tips dislodge residual buildup by a wiping action effectuated while the cleaning tips are within the openings, and if a cleaning tip encounters an exceptionally resistant residual buildup, the corresponding rod may be bent as the apparatus nevertheless continues to attempt to change the position of the tip. The present invention avoids this problem by not substantially changing the position of the tips at a time when they could be bound within the openings 22.

Figure 2:
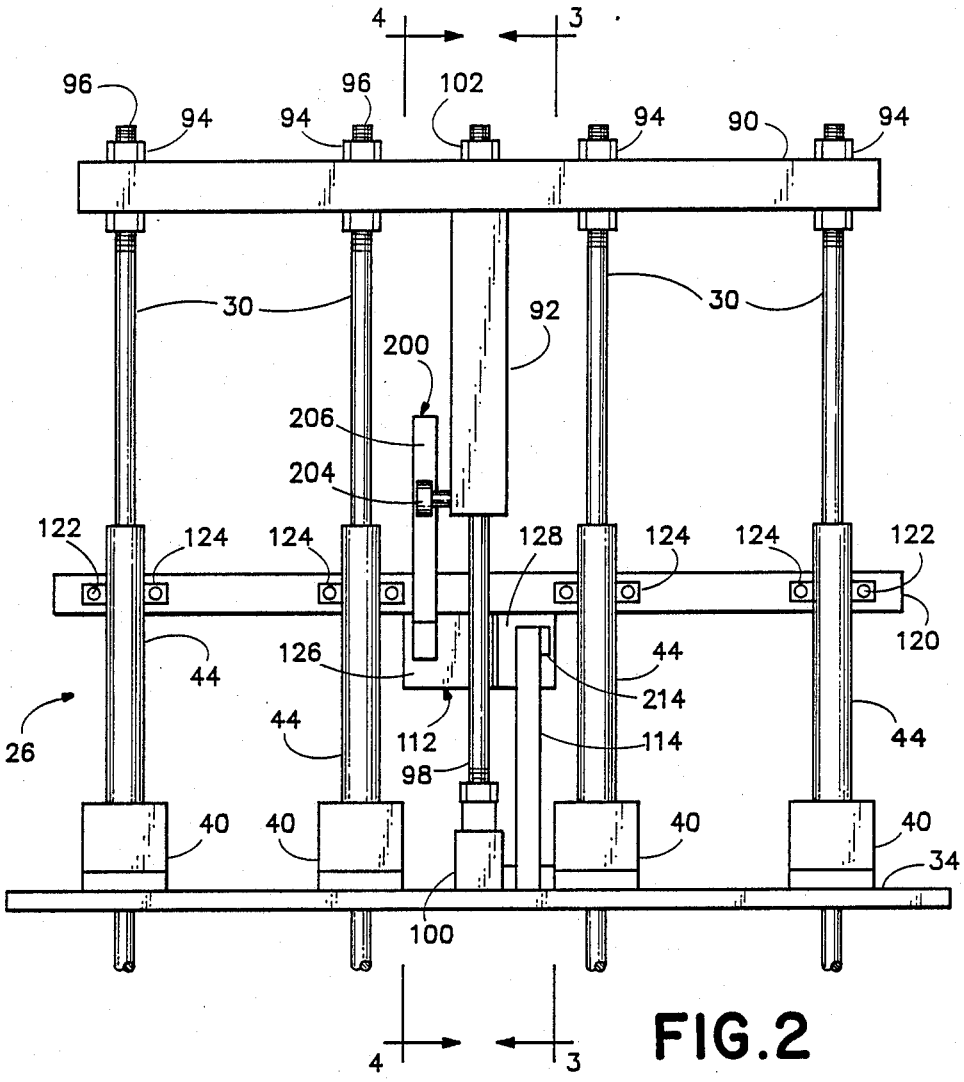
FIG. 2 is a plan view of apparatus according to the present invention.
Figure 11:
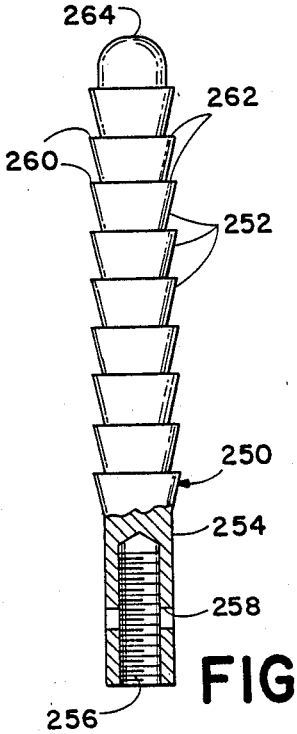
FIG. 11 is a plan view of an improved cleaning tip in accordance with the instant invention.

Referring now to FIG. 11, an improved cleaning tip 250 is shown having a plurality of serrations 252 spaced substantially along the length of the tip 250 and extending around the periphery thereof. A base 254 of the tip includes a tapped hole 256 receiving the rod 30 (not shown) therein, and a transverse bore 258 through the base 254 receiving a pin for holding the tip 250 attached to the shaft. The tip 250 is suitably formed as by casting from a heat resisting material such as No. 446 alloy, which is a high chromium ferritic alloy. The cleaning tip 250 is substantially square in cross section, the serrations 252 being approximately one and three-eighths inches square on serrate edges 260 and one inch square at bases 262 of the serrations. An end 264 of the tip 250 is suitably rounded to facilitate guiding the tip into the air port opening. It has been found that cleaning action wherein the tip 250 is inserted by ramming into the opening, i.e., repeated longitudinal translation rather than wiping the tip inside the opening, provides superior cleaning because the serrate edges 260 of the tip 250 can chip away hardened excrescent deposits that otherwise would resist the action of the cleaning tip or even bind the tip in the opening. Further, the serrated tip 250 is easily withdrawn from the opening and is not subject to binding therein. It is seen that approximately two to three serrations 252 are inserted into an opening during a cleaning cycle, the tip being adjustable inward as it erodes away with extended use, by loosening the bolt 94 and adjusting the rod end 96 inward (FIGS. 2 and 3).

In the working environment, workers are often required to work in the vicinity of the cleaning apparatus 26, and it has been found that these workers sometimes find it necessary to stand upon the crossbar 90, this activity potentially applying force to the rods, which if translated to the output shaft 170, could produce torque that exceeds the design limits of the no-back clutch 126. To relieve such excess force, the torque-limiting clutch 128 allows the output shaft 170 to rotate with respect to the output shaft 136 of the no-back clutch 126 upon application thereto of a predetermined level of torque. As the output shaft 170 moves, the rods 30 move to the limit of their range of vertical motion, i.e., to top-dead-center or bottom-dead-center of the eccentric 210, where torque is no longer applied to the output shaft 170.

While a preferred embodiment of the present invention has been shown and described, it will be apparent to those skilled in the art that many changes and modifications may be made without departing from the invention in its broader aspects. For example, the indexing clutch could be such that an absolute point of insertion could be selected instead of simply incrementing or decrementing its current position. The indexing clutch could be replaced by a number of mechanisms, such as servo and stepper motors, to control the angular position of the rods. An alternative embodiment of the indexing mechanism utilizes a constant-torque slip clutch which is responsive to torque applied thereto within a range of approximately 150 to 300 inch-pounds to transmit the applied torque to the output shaft.

While discontinuous or stepped indexing is the preferred embodiment and the best mode of implementing the invention at present, it is seen that the tip may be moved incrementally by slowly (with respect to the longitudinal translation of the rods) and continuously pivoting the rod so as to move the tips to a new point of insertion each time the tip is successively inserted into the opening. In this latter described embodiment of the invention, virtually no wiping action of the tip occurs while the tip is inserted in the opening because a plurality of insertion and withdrawal cycles occur during the time when the tip translates through the height of the opening, and the cleaning action is essentially a ramming action. Further, rods 30 need not be pivotable if, for example, positioning means were provided to displace said rods in a direction perpendicular to their longitudinal translation so as to control their point of insertion and retraction. The appended claims are therefore intended to cover all such changes and modifications as fall within the true spirit and scope of the invention.

I claim:

1. Apparatus for cleaning an opening in a furnace, said apparatus comprising:

a rod provided with a cleaning tip adapted for insertion into the opening;

means for translating said rod in a first direction primarily longitudinal of said rod to insert said cleaning tip into the opening to dislodge residual buildup therefrom and including means for subsequently retracting said cleaning tip from the opening;

means for indexing said cleaning tip to control a point of insertion of said cleaning tip into said opening; and means for alternate actuation of said translating means and said indexing means whereby said cleaning tip is indexed between successive insertions by a predetermined amount to provide controlled spacing between successive points of insertion of said cleaning tip into said opening.

2. The apparatus of claim 1 wherein said indexing means changes the angular position of said rod with respect to said opening.

3. The apparatus of claim 2 wherein said change in angular position of said rod occurs while said rod is translating longitudinally.

4. The apparatus of claim 1 wherein said alternate actuation means is actuated a predetermined number of times to successively index said cleaning tip to a plurality of points of insertion to dislodge residual buildup in substantially all portions of said opening.

5. The apparatus of claim 1 wherein said furnace includes a plurality of openings and said apparatus includes a plurality of rods, each rod having a cleaning tip adapted for insertion into a corresponding one of the openings; said translating means comprises a plurality of tubes rotatably mounted to said furnace and slidably receiving said rods; and wherein said translating means includes means for moving said rods in unison within said tubes.

6. The cleaning apparatus of claim 1 wherein said cleaning tip comprises an elongate member having a serrate edge.

7. The cleaning apparatus of claim 6 wherein said serrate edge faces the opening as said cleaning tip approaches the opening for insertion therein.

8. A method for cleaning an opening in a firebox, said method comprising providing a means for automatically cleaning said opening by a sequence of steps including:

a. actuating a rod having a cleaning tip thereon;

b. inserting the cleaning tip into the opening to dislodge excrescent material from the opening;

c. withdrawing the cleaning tip from the opening subsequent to said step of inserting the cleaning tip;

d. indexing the cleaning tip to another point of insertion of the opening, said indexing step being subsequent to said withdrawing step; and e. repeating steps b, c and d until the entire opening is cleaned.

9. The method according to claim 8 wherein the step of inserting the cleaning tip into the opening includes the step of ramming the tip longitudinally into the opening.

10. Apparatus for cleaning an opening in a wall of a firebox, the opening introducing combustion air into the firebox from a wind box supplying air under pressure to the opening, said apparatus comprising:

a rod provided with a cleaning tip on an end thereof, said cleaning tip being adapted for insertion into the opening at a first point of insertion of the opening;

a mount affixed exteriorly of the wind box;

a tube pivotally attached to said mount and extending outwardly from said mount exteriorly of said wind box, said rod being slidably received in said tube and extending therefrom through said wind box toward the opening;

an actuator attached to said mount and connected to said rod, said actuator being operable to advance said rod longitudinally from an at-rest position toward the opening and insert said cleaning tip into the opening, and subsequently to retract said rod from the opening; and an indexing mechanism attached between said tube and said mount, said indexing mechanism being operable to pivot said tube with respect to said mount, said actuator contacting said indexing mechanism when retracting said rod to operate said indexing mechanism and pivot said tube by a predetermined amount to index said cleaning tip to another point of insertion of the opening.

11. The cleaning apparatus of claim 10, wherein said indexing mechanism successively indexes said cleaning tip during successive retractions of said rod from the opening such that said cleaning tip is inserted at a plurality of different points of insertion of the opening at definite intervals of space along the opening.

12. The cleaning apparatus of claim 10 wherein said indexing mechanism comprises a clutch assembly affixed to said tube.

13. The cleaning apparatus of claim 12 wherein said clutch assembly comprises:

a no-back clutch having an input shaft and an output shaft;

an overrunning roller clutch attached to said input shaft;

an actuating arm attached to said overrunning roller clutch and extending from said clutch assembly toward said actuator, said actuator contacting said actuating arm when retracting said rod and moving said actuating arm to rotate said input shaft by a predetermined amount;

an eccentric attached to said output shaft;

a connecting rod rotatably attached to said eccentric and pivotally connected to a reference bearing of said mount.

14. The cleaning apparatus of claim 12, wherein said clutch assembly comprises:

a no-back clutch having an input shaft and a first output shaft;

a torque-limiting clutch connected to said first output shaft and having a second output shaft, said second output shaft turning independently of said first output shaft when torque exceeding a predetermined limit is applied to said second output shaft;

an overrunning roller clutch attached to said input shaft;

an actuating arm attached to said overrunning roller clutch and extending from said clutch assembly toward said actuator, said actuator contacting said actuating arm when retracting said rod and moving said actuating arm to rotate said input shaft by a predetermined amount;

an eccentric attached to said second output shaft;

a connecting rod rotatably attached to said eccentric and pivotally connected to a reference bearing of said mount.

15. The cleaning apparatus of claim 10 wherein said cleaning tip comprises an elongate member having a serrate edge.

16. The cleaning apparatus of claim 15 wherein said serrate edge faces the opening as said cleaning tip approaches the opening for insertion therein.

17. Apparatus for cleaning an opening in a furnace, said apparatus comprising:

a rod provided with a cleaning tip adapted for insertion into the opening and comprising an elongate member having a serrate edge, means for translating said rod in a direction primarily longitudinal of said rod for inserting said cleaning tip into the opening and retracting said cleaning tip from the opening to dislodge residual buildup therefrom;

indexing means responsive to said translating means for changing an angular position of said rod so as to control a point of insertion of said cleaning tip into the opening and a point of retraction of said cleaning tip from the opening; and means for actuating said translating means a sufficient number of times to dislodge residual buildup along substantially all edges of the opening.

18. The cleaning apparatus of claim 17 wherein said serrate edge faces the opening as said cleaning tip approaches the opening for insertion therein.

19. Apparatus for cleaning an opening in a firebox, said apparatus comprising:

a rod with a cleaning tip adapted for insertion into the opening, said cleaning tip being smaller than said opening in at least one lateral direction and comprising an elongated member having a serrate edge; and actuating means for advancing said rod in a direction primarily longitudinal of said rod toward the opening to insert said cleaning tip into the opening, said cleaning tip entering the opening at a first point of insertion of the opening, said actuating means including means for subsequently retracting said rod to withdraw said cleaning tip from the opening and including means responsive to said rod retracting for moving said rod at least in said one direction to position the cleaning tip for subsequent reinsertion into the opening at a second point of insertion of said opening.

20. The cleaning apparatus of claim 19 wherein said serrate edge faces the opening as said cleaning tip approaches the opening for insertion therein.

21. Apparatus for cleaning an opening in a firebox, said apparatus comprising:

a rod provided with a cleaning tip adapted for insertion into the opening, said cleaning tip being smaller than said opening in at least one lateral direction; and actuating means for advancing said rod in a direction primarily longitudinal of said rod toward the opening to insert said cleaning tip into the opening, said cleaning tip entering the opening at a first point of insertion of the opening, said actuation means including means for subsequently retracting said rod to withdraw said cleaning tip from the opening and including means for responsive to said rod retracting for moving said rod at least in said one direction to position the cleaning tip for subsequent reinsertion into the opening at a second point of insertion of said opening;

said cleaning tip comprising an elongate member having a plurality of serrated edges facing the opening as said cleaning tip approaches the opening for insertion therein; and said cleaning apparatus including means for adjusting the depth to which said cleaning tip penetrates the opening.

22. Apparatus for cleaning an opening in a furnace, said apparatus comprising:

a rod provided with a cleaning tip adapted for insertion into the opening, the cleaning tip being substantially smaller than the opening in at least one lateral direction relative to said rod;

means for longitudinal translation of said rod relative to the opening in a longitudinal direction relative to said rod to dislodge residual buildup from the opening;

means for lateral translation of said rod relative to the opening in said one lateral direction relative to said rod; and actuation means for causing a first actuation of said longitudinal translation means to clean a portion of said opening and for subsequenty causing a first actuation of said lateral translation means to position the cleaning tip to clean a second portion of said opening in preparation for a second actuation of said longitudinal translation means.

23. The apparatus of claim 22 wherein said indexing means includes means for changing the angular position of said rod with respect to said opening.

24. The apparatus of claim 22 wherein said lateral translation means comprises a clutch operated by sai alternate actuation means and attached through an eccentric to said rod, whereby said rod is moved to index said cleaning tip.

25. The apparatus of claim 22 wherein the furnace includes a plurality of openings and said apparatus includes a plurality of rods, each rod having a cleaning tip adapted for insertion into a corresponding one of said openings; wherein said lateral translation means comprises a plurality of tubes rotatably mounted to said furnace and slidably receiving said rods, a crossbar connected to each of said tubes, and a clutch operated by said alternate actuation means and attached through an eccentric to said crossbar whereby said crossbar is moved to index said cleaning tips.

26. The apparatus of claim 22 wherein said furnace includes a plurality of openings and said apparatus includes a plurality of rods, each rod having a cleaning tip adapted for insertion into a corresponding one of said openings; said lateral translation means comprising a plurality of tubes rotatably mounted to said furnace and slidably receiving said rods, a crossbar connected to each of said tubes, and a clutch operated by said alternate actuation means and attached through an eccentric to said crossbar, whereby said crossbar is moved to index said cleaning tips.

27. Apparatus for cleaning a plurality of openings in a furnace, said apparatus comprising:

a plurality of rods each provided with a cleaning tip adapted for insertion into a corresponding one of said openings;

means for translating each rod in a direction primarily longitudinal of each rod to insert each cleaning tip into the corresponding opening to dislodge residual buildup therefrom and including means for subsequently retracting each cleaning tip from the corresponding opening, said translating means comprising a plurality of tubes each rotatably mounted to said furnace and slidably receiving a corresponding one of said rods, said translating means further comprising means for moving said rods in unison within said tubes including a crossbar connected to each of said rods and an air cylinder coupling said crossbar to said furnace such that said rods may be translated by said air cylinder in relation to said furnace; and means for indexing said cleaning tips to control a point of insertion of each cleaning tip into the corresponding opening.

28. Apparatus for cleaning an opening in a furnace, said apparatus comprising:

a rod provided with a cleaning tip adapted for insertion into the opening;

means for translating said rod in a first direction primarily longitudinal of said rod to insert said cleaning tip into the opening to dislodge residual buildup therefrom and including means for subsequently retracting said cleaning tip from the opening; and means for indexing said cleaning tip to control a point of insertion of said cleaning tip into said opening, said indexing means comprising a clutch operated by said retracting means and attached through an eccentric to said rod, whereby said rod is moved to index said cleaning tip.

29. Apparatus for cleaning a plurality of openings in a furnace, said apparatus comprising:

a plurality of rods each provided with a cleaning tip adapted for insertion into a corresponding one of said openings;

means for translating each rod in a direction primarily longitudinal of each rod to insert each cleaning tip into the corresponding opening to dislodge residual buildup therefrom and including means for subsequently retracting each cleaning tip from the corresponding opening; and means for indexing said cleaning tip to control a point of insertion of said cleaning tip into said opening, said indexing means comprising a plurality of tubes rotatably mounted to said furnace and slidably receiving corresponding ones of said rods, a crossbar connected to each of said tubes, and a clutch operated by said retracting means and attached through an eccentric to said crossbar, whereby said crossbar is moved to index said cleaning tips.

30. Apparatus for cleaning a plurality of openings in a furnace, said apparatus comprising:

a plurality of rods each provided with a cleaning tip adapted for insertion into a corresponding one of the openings;

means for translating each rod in a direction primarily longitudinal of each rod for inserting each cleaning tip into the corresponding opening and retracting each cleaning tip from the corresponding opening to dislodge residual buildup therefrom, said translating means comprising a plurality of tubes each rotatably mounted to said furnace and slidably receiving a corresponding one of said rods, a first crossbar connected to each of said rods, and an air cylinder coupling said first corssbar to said furnace; and indexing means responsive to said translating means for changing an angular position of each rod so as to control a point of insertion of each cleaning tip into the corresponding opening and a point of retraction of each cleaning tip from the corresponding opening, said indexing means comprising a second crossbar connected to each of said tubes, and a clutch operated by said air cylinder and attached through an eccentric to said second crossbar, whereby said second crossbar is moved to index said cleaning tips.

* * * * *

UNITED STATES PATENT AND TRADEMARK OFFICE

CERTIFICATE OF CORRECTION

PATENT NO. : 4,822,428

DATED : April 18, 1989

INVENTOR(S) : BYRON L. GOODSPEED

It is certified that error appears in the above-identified patent and that said Letters Patent is hereby corrected as shown below:

Column 1, line 46, "on" should be --in--.

Column 12, line 12, between "rod" and "with", insert --provided--.

Column 13, line 15, "sai" should be --said--.

Column 14, line 50, "corssbar" should be --crossbar--.

Signed and Sealed this

Third Day of October, 1989

*Attest:*

*Attesting Officer*

DONALD J. QUIGG

*Commissioner of Patents and Trademarks*